US011761182B2

(12) United States Patent
Hofman

(10) Patent No.: US 11,761,182 B2
(45) **Date of Patent: *Sep. 19, 2023**

(54) DUAL SHOWERHEAD ASSEMBLY WITH BALL JOINT CONNECTION

(71) Applicant: ETL, LLC, Sparks, NV (US)

(72) Inventor: David Hofman, Reno, NV (US)

(73) Assignee: ETL, LLC, Sparks, NV (US)

( * ) Notice: Subject to any disclaimer, the term of this patent is extended or adjusted under 35 U.S.C. 154(b) by 68 days.

This patent is subject to a terminal disclaimer.

(21) Appl. No.: 17/241,512

(22) Filed: Apr. 27, 2021

(65) Prior Publication Data

US 2022/0341135 A1 Oct. 27, 2022

(51) Int. Cl.
*E03C 1/04* (2006.01)
*B05B 1/18* (2006.01)

(52) U.S. Cl.
CPC ..... *E03C 1/0408* (2013.01); *B05B 1/18* (2013.01)

(58) Field of Classification Search
CPC ..... E03C 1/0408; B05B 1/18
See application file for complete search history.

(56) References Cited

U.S. PATENT DOCUMENTS

| | | | | |
|---|---|---|---|---|
| D626,197 | S | 10/2010 | Gilbert | |
| 7,993,070 | B2 | 8/2011 | Kull et al. | |
| 8,132,745 | B2 | 3/2012 | Leber et al. | |
| 9,149,817 | B2 * | 10/2015 | Lev | E03C 1/0408 |
| 9,687,860 | B2 | 6/2017 | Huffington et al. | |
| D803,350 | S * | 11/2017 | Tian | D23/228 |
| 9,919,331 | B2 | 3/2018 | Scheffer et al. | |
| 10,533,309 | B2 | 1/2020 | Genord et al. | |
| 2019/0176170 | A1 | 6/2019 | Lee et al. | |
| 2019/0351444 | A1 * | 11/2019 | Berlovan, Jr. | B05B 1/18 |
| 2020/0360955 | A1 * | 11/2020 | Huang | B05B 15/68 |

FOREIGN PATENT DOCUMENTS

| | | |
|---|---|---|
| CN | 10607667 | 3/2019 |
| CN | 112604831 | * 11/2020 |
| GB | 2417756 | 3/2006 |

* cited by examiner

*Primary Examiner* — Qingzhang Zhou
(74) *Attorney, Agent, or Firm* — David G. Duckworth; ONE LLP

(57) ABSTRACT

A showerhead assembly is provided which includes a handheld showerhead removably connected to a stationary showerhead through ball joint connection. The handheld showerhead includes an elongate handle having an upper housing with a cavity, and a front face including one or more nozzles for spraying water. The stationary showerhead has a traditional showerhead construction, with the exception that it further comprises a ball which engages with the handheld showerhead's cavity so as to allow rotatable and secure attachment of the handheld showerhead to the stationary showerhead. The ball may include a preliminary alignment chamber which houses a locking chamber, and the cavity may include a tension pin which engages with both these chambers so as to provide further support for installation of the handheld showerhead to the stationary showerhead. In addition, a spring-button tab mechanism may be utilized for managing the engagement and disengagement of the ball with the cavity.

14 Claims, 8 Drawing Sheets

DUAL SHOWERHEAD ASSEMBLY WITH BALL JOINT CONNECTION

BACKGROUND OF THE INVENTION

The present invention relates to showerheads. More particularly, the present invention relates to handheld showerheads incorporating ball joint connections to stationary showerheads.

Showerheads are commercially available in numerous designs and configurations for use in showers, faucets, spas, sprinklers and other personal and industrial systems. The vast majority of showerheads include spray heads which may be categorized as being either stationary or oscillating and have either fixed or adjustable openings. Stationary spray heads with fixed jets are the simplest constructions consisting essentially of a central channel connected to one or more spray nozzles directed to produce a constant pattern. Multi-function spray heads are able to deliver water in different spray patterns such as a fine spray, a coarse spray, a pulsating spray, or even a flood pattern producing a high fluid flow.

A handheld showerhead assembly typically includes a hollow handle connected to a water supply by a flexible rubber hose. The handle has a proximal end which typically has a threaded inlet for connecting to the rubber hose. Meanwhile, at the handle's distal end, the showerhead assembly includes a showerhead including a plurality of nozzles for ejecting water. Typically, the handle and showerhead face are angled relative to one another so that water is ejected at approximately 90 degrees relative to the handle's longitudinal axis.

Advantageously, the showerhead handle allows users to manipulate the spray nozzles into various positions and alignment to assist in the cleaning process. Unfortunately, though handheld showerheads provide many advantages compared to their fixed showerhead counterpart, handheld showerheads suffer from several disadvantages. For example, U.S. Pat. No. 9,919,331 and Chinese Patent No. 106076677 describe handheld showerhead assemblies that utilize a magnet attachment mechanism. In these embodiments, the magnet retention mechanism may be unsecure, causing the handheld showerhead to inadvertently release from its desired attached position.

Additionally, many showerhead assemblies include handheld showerheads which insert or slide into a given slot or bracket. Examples of such constructions are disclosed in U.S. Pat. Nos. 7,966,677, 7,665,676 and U.S. Patent Application Publication No. 2019/0176170. However, none of these embodiments disclose a handheld assembly that utilizes a rotatable, ball joint attachment mechanism.

Indeed, many of these embodiments disclose a handheld showerhead assembly that is fixed in its mount position. Thus, it would be advantageous to provide a showerhead assembly that included a ball joint attachment which would allow the user to manipulate or change the angle of the handheld showerhead.

Traditionally, handheld showerhead assemblies attach to an arm mount using a hose connection. Unfortunately, this elevates the positioning of the showerhead and could be problematic for users with short height, low ceilings, or high shower arms. Thus, it would be further advantageous to provide a handheld showerhead assembly with an attachment point at an upper housing of the handheld showerhead such that handle would be oriented at a lower position.

Additionally, more recently, shower stalls have been provided with a primary showerhead, and additional nozzles which project directly from the shower stall's sidewalls which spray water in different directions than the primary showerhead. Unfortunately, these constructions require that expensive plumbing additions be made to the shower stall facility. Thus, it would be advantageous to provide a showerhead assembly that included a stationary showerhead as well as a handheld showerhead that could be removably and rotatably docked thereto, so as to allow the user to individually manipulate the direction of water sprayed through different showerheads within a shower stall.

SUMMARY OF THE INVENTION

The present invention addresses the aforementioned disadvantages by providing an improved showerhead assembly which includes a stationary showerhead which supports a handheld showerhead through a ball joint attachment. The showerhead assembly includes a handheld showerhead including a showerhead housing having a face with a plurality of nozzles for expelling water such as within a shower. Various showerhead face shapes and nozzle constructions can be determined by one skilled in the art.

The handheld showerhead further includes a hollow handle with a proximal end which preferably is threaded for connecting to a flexible hose. The handle is elongate so as to define a longitudinal axis, and preferably, the distal end of the handle affixes to the showerhead at an angle, such as 45° to 90°. Preferably, the handheld showerhead may have control knobs or levers for diverting water to different handheld showerhead nozzles such as to provide different spray patterns.

Additionally, the handheld showerhead includes a channel having an inlet for receiving water for being expelled from the showerhead nozzles. Various channel, conduit and nozzle constructions can be determined by those skilled in the art for diverting water from the inlet to the showerhead's nozzles.

Further, the showerhead assembly of the present invention further possesses a stationary showerhead which releasably holds the handheld showerhead. Preferably, the stationary showerhead includes a showerhead body having a faceplate with spray nozzles. Various showerhead face shapes and nozzle constructions can be determined by one skilled in the art. Moreover, the showerhead body includes a primary conduit for transporting water to one or more spray nozzles for spraying water. The stationary showerhead may have control knobs or levers for diverting water to different nozzles such as to provide different spray patterns.

Providing the "ball" portion of the ball joint connector, the stationary showerhead's body includes a ball which extends downwardly from the stationary showerhead's body. The ball is sized and configured to releasably engage within a cavity within the handheld showerhead. Even more specifically, the handheld showerhead's substantially spherical cavity defines a space sized and configured to be complementary to the stationary showerhead's ball so as to form a ball joint construction. In a preferred construction, the ball within the cavity provides a press-fit attachment of the elements therebetween. Upon installation of the showerhead cavity to the ball, the handheld showerhead is thereby removably and rotatably docked onto the stationary showerhead. Additionally, the handheld showerhead affixes to the stationary showerhead at an angle such that the stationary showerhead's face and the handheld showerhead's face axially align on the same plane. Alternatively, the handheld showerhead affixes to the stationary showerhead at an angle such that the stationary showerhead's face and the handheld showerhead's face are offset so as to not align on the same parallel axis.

To connect to the stationary showerhead's ball element, the handheld showerhead's housing includes a substantially spherical cavity. A "substantially spherical cavity" is defined as a cavity having a concave curved shape sized so as to accept the stationary showerhead's ball. However, "substantially spherical cavity" is intended to be interpreted broadly such that the entire cavity need not have concave surface. For example, the substantially spherical cavity may include a portion of the surface that is planar such as to form a frusto-spherical shape.

In the preferred embodiment, the handheld showerhead's cavity has a frusto-spherical shape and includes a planar surface and a tension pin which axially protrudes from the cavity's planar surface. The tension pin is sized and configured to engage with the stationary showerhead's ball when the ball is positioned within the handheld showerhead's cavity. Specifically, the ball has a distal end comprising a preliminary alignment chamber which houses a locking chamber axially aligned therein. Even more specifically, the tension pin engages with the ball's locking chamber so as to prevent over-rotation of the ball joint or inadvertent release of the showerhead handle. Additionally, the tension pin engages with the ball's preliminary alignment chamber to further stabilize and secure the connection realized between the handheld showerhead and stationary showerhead. Additional or alternative ball joint assemblies for providing these capabilities can be selected by those skilled in the art.

In a preferred embodiment, the showerhead cavity does not include any sort of mechanical latching mechanism for locking the stationary showerhead's ball within the handheld showerhead's cavity. Instead, for this embodiment, the ball has a diameter slightly larger than the cavity's opening, but the ball is made of a malleable material that is capable of deforming to squeeze through the cavity's opening when the handheld showerhead is connected to or disconnected from the stationary showerhead. Rubber, silicone or similar materials are considered preferred malleable materials for the ball's construction.

In another preferred embodiment, the showerhead handle includes a spring-loaded button and tab mechanism wherein the button extends from the backside of the handle and extends from a tab which pivotally moves with respect to the button and spring configuration. Specifically, a spring is disposed within an opening in the handle and compresses and decompresses as a function of the button and tab. Even more specifically, when the button is pressed, the spring is decompressed and the tab extends upwardly so as to protrude into the cavity area and capture the ball received in the cavity. Conversely, when the button is depressed, the spring compresses and the tab pivots downwardly. The tab is positioned and configured so that when it pivots downwardly, it is no longer protruding into the cavity so as to provide an engagement point which allows the ball to release from within the cavity. Various spring-loaded button and tab constructions for providing these capabilities can be selected by those skilled in the art.

Moreover, the stationary showerhead's body is connected to a neck portion which preferably includes a female threaded inlet connecting to a male threaded pipe providing the source of water. Preferably, the neck portion is affixed to the inlet by ball and socket attachment so as to allow rotation about a central axis. The neck portion has central conduit that is connected to the handheld showerhead's flexible hose so as to transport water from the inlet to the hose outlet, and ultimately, the handheld showerhead's nozzles. Additionally, the neck portion's central conduit delivers water to the primary conduit, and ultimately, the stationary showerhead's nozzles. Preferably, the neck portion may have control knobs or levers for diverting water to different showerhead nozzles on the stationary showerhead such that different spray patterns are produced.

Therefore, it is an object of the invention to provide a showerhead assembly which includes a stationary showerhead connected to a traditional pipe found in shower stall, as well as a handheld showerhead through a ball joint connection. Advantageously, the ball joint connection allows the bather to controllably rotate the handheld showerhead so as to divert the water stream to different locations within the showerhead environment.

Also advantageously, the showerhead assembly provides for secure retention of the handheld showerhead onto the stationary showerhead. Such a construction also allows the bather to contemporaneously experience multiple sprays with varying spray patterns and trajectories.

Other features and advantages of the present invention will be appreciated by those skilled in the art upon reading the detailed description which follows with reference to the drawings.

DETAILED DESCRIPTION OF THE INVENTION

Figure 1:
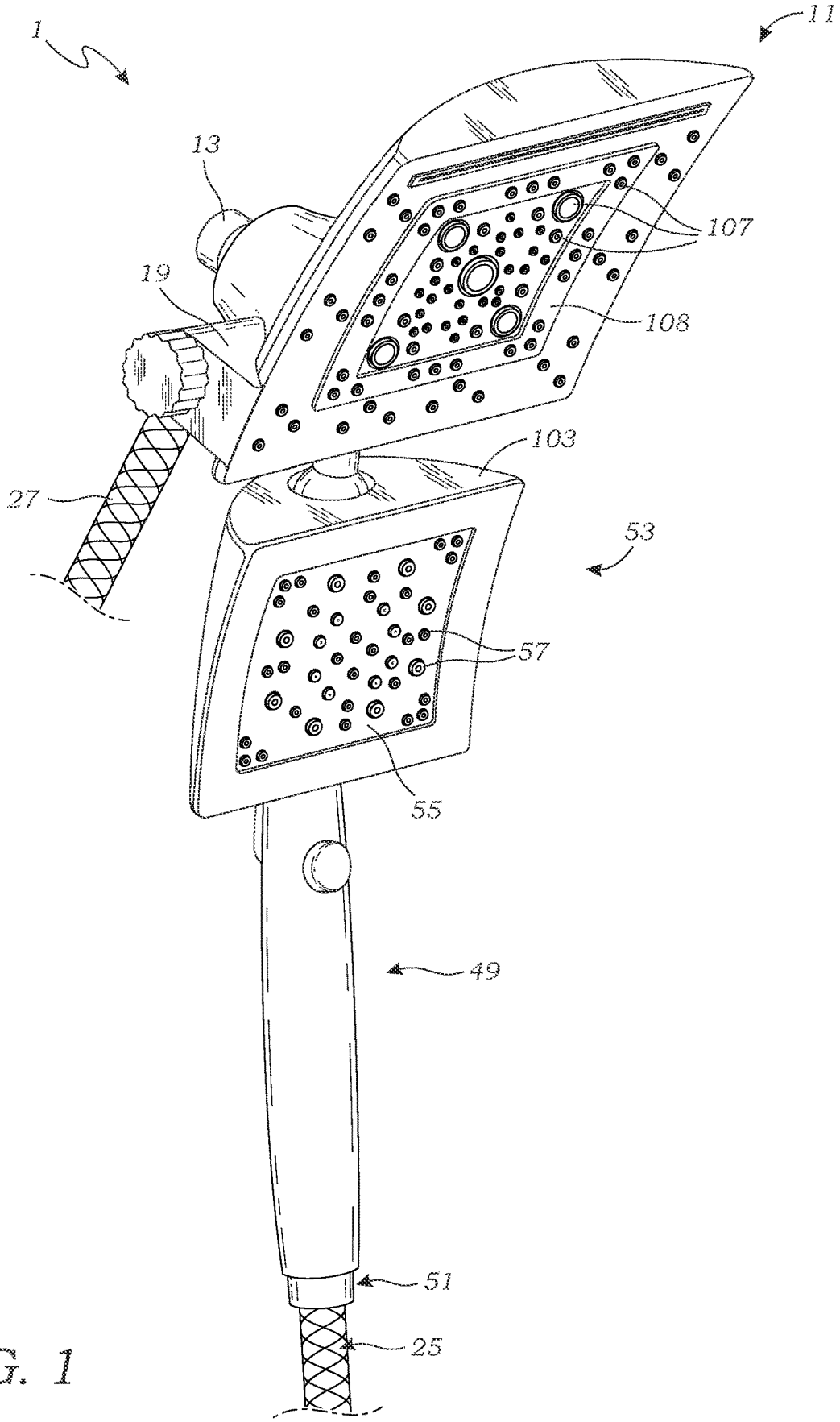
FIG. 1 is a front perspective view of the handheld showerhead assembly, wherein the handheld showerhead is installed to the stationary showerhead through a ball joint connection, and the handheld showerhead face and the stationary showerhead face are both square shaped.
Figure 2:
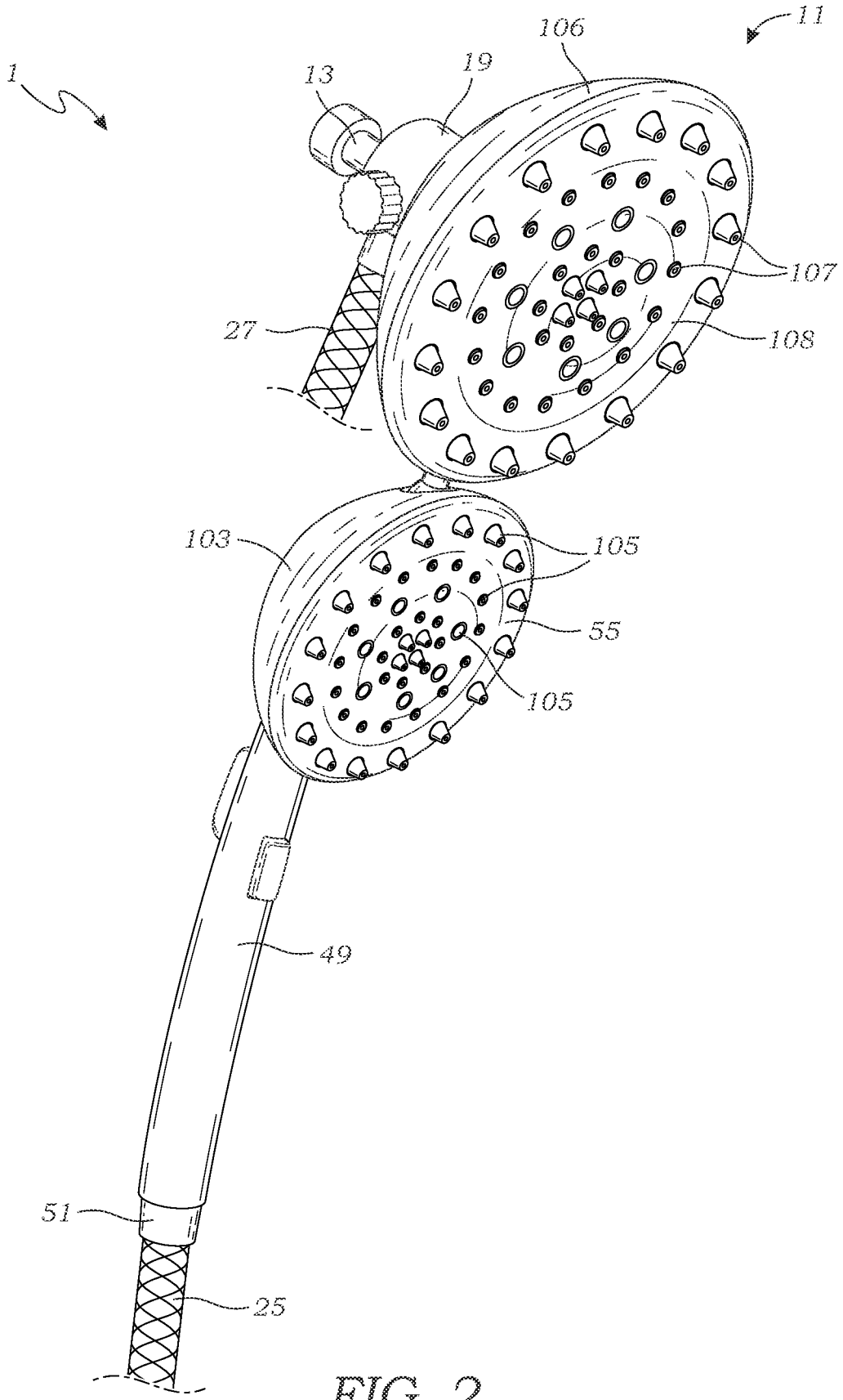
FIG. 2 is front perspective view of an alternative embodiment of the handheld showerhead assembly of FIG. 1, wherein the handheld showerhead face and the stationary showerhead face are both circular in shape.

While the present invention is susceptible of embodiment in various forms, as shown in the drawings, hereinafter will be described the presently preferred embodiments of the invention with the understanding that the present disclosure is to be considered as an exemplification of the invention, and it is not intended to limit the invention to the specific embodiments illustrated.

With reference to all FIGS. 1-9, the showerhead assembly 1 includes a stationary showerhead 11 which dually functions as a showerhead and a mounting structure for supporting a handheld showerhead 53 through ball joint attachment. The handheld showerhead portion of the showerhead assembly 1 has unique features but, like traditional constructions, includes a hollow handle 49 having a proximal end 51, which threadably affixes to a flexible hose 41 having a first end 25 and a second end 27, and a distal end 101 which includes the handheld showerhead 53. The handle 49 includes a longitudinal axis, and preferably the handheld showerhead 53 affixes to the distal end 101 of the handle 49 at an angle, such as 45° to 90°, relative to the handle's 49 longitudinal axis. Preferably, the handheld showerhead handle 49 may have control knobs or levers for diverting water to different handheld showerhead nozzles such as to provide different spray patterns. As illustrated in the Figures, a control knob or lever may be positioned on the handle's front side, however, other knob or lever orientations can be appreciated by those skilled in the art.

The showerhead assembly's handheld showerhead includes a showerhead housing 103 that has a front face 55 through which a plurality of nozzles 57 project. As understood by those skilled in the art, water is capable of flowing through a channel (not shown) within the center of the handle 49 which connects to the showerhead's nozzles 57 which are constructed to spray water. Various channel, conduit, showerhead face, and nozzle constructions can be determined by those skilled in the art for diverting water from the inlet to the showerhead's nozzles.

Additionally, and as illustrated in the Figures, the handheld showerhead 53 has a housing 99 which includes a substantially spherical cavity 15 which projects into the housing's 99 top side. A substantially spherical cavity is defined as having a substantial portion of its body have a spherical or curved shape, but wherein a portion of the surface may be planar such as to form a frusto-spherical shape. In a preferred embodiment, the cavity 15 is composed of rubber or plastic material. Moreover, as illustrated in FIGS. 1-5, the handheld showerhead's hollow handle 49 has a proximal end 51 which preferably has male threads so as to couple to the female threads found on the first end 25 of a traditional flexible hose 41.

The showerhead assembly 1 further comprises a unique stationary showerhead 11 which is configured to releasably hold and support the handheld showerhead 53. Like traditional showerheads, the stationary showerhead 11 includes a body 106 having a faceplate 108 with a plurality of spray nozzles 107. The showerhead body further includes one or more of the stationary showerhead's spray nozzles 107 for spraying water. Additionally, as illustrated in each of the Figures, the stationary showerhead 11 is connected to a showerhead assembly neck portion 19 having a central conduit which connects to an inlet 13. Preferably, the inlet 13 includes female threads for connecting to the male threads found at the end of a traditional shower stall pipe. Even more preferably, the stationary showerhead's neck portion 19 is connected to the inlet 13 by a ball and socket attachment. Specifically, the ball and socket allow the neck portion 19 to rotate and swivel in any direction about the ball's center.

Moreover, the central conduit is in fluid connection with the inlet 13 so as to receive water therefrom and transport such water through the primary conduit, and ultimately, expel such water through spray nozzles 107 projecting from the stationary showerhead's faceplate 108. Additionally, control knobs or levers may be utilized to divert water through different nozzles or to alter water spray patterns. In a preferred embodiment, and as illustrated in FIGS. 1-4, and 6-9, the neck portion 19 includes a control knob for diverting water through the stationary showerhead's spray nozzles 107 so as to allow the bather to vary the spray pattern experienced through the nozzles 107.

Preferably, the neck portion 19 includes male threads for connecting to the female threaded second end 27 of the flexible hose 41. Even more preferably, water is transported from the neck portion's central conduit to a hose outlet housed within the flexible hose 41, so as to expel water through the handheld showerhead's nozzles 57.

In a preferred embodiment, the neck portion 19 includes a diverter which incorporates a valve assembly for manually controlling the flow of water received from the inlet 13 so as to permit or obstruct the flow of water through the primary conduit and hose outlet. In another preferred embodiment, a valve assembly consisting of an on/off button is incorporated onto the showerhead assembly so as to permit and/or obstruct water flow from the central conduit to the different showerheads' nozzles. Even more preferably, water flow is blocked by depression of a valve button, and conversely, water flow is promoted when the button is not depressed. Additional or alternative diverter or valve assemblies for providing these capabilities can be selected by those skilled in the art.

Moreover, and as illustrated in FIGS. 1-9, the stationary showerhead's body 106 includes a lower portion 104 by which the stationary showerhead 11 supports the handheld showerhead 53. Specifically, a ball 33 extends downwardly from the stationary showerhead's lower portion 104. The ball 33 is sized and configured to releasably engage with the handheld showerhead's cavity 15 and the ball's 33 convex curved area allows the engaged handheld showerhead cavity 15 to rotate or swivel about a central axis. The handheld showerhead's cavity 15 defines a space correspondingly configured for receipt of the ball 33. Upon engagement of the cavity 15 with the ball 33, the handheld showerhead 53 is thereby removably and rotatably docked onto the stationary showerhead 11.

Figure 3:
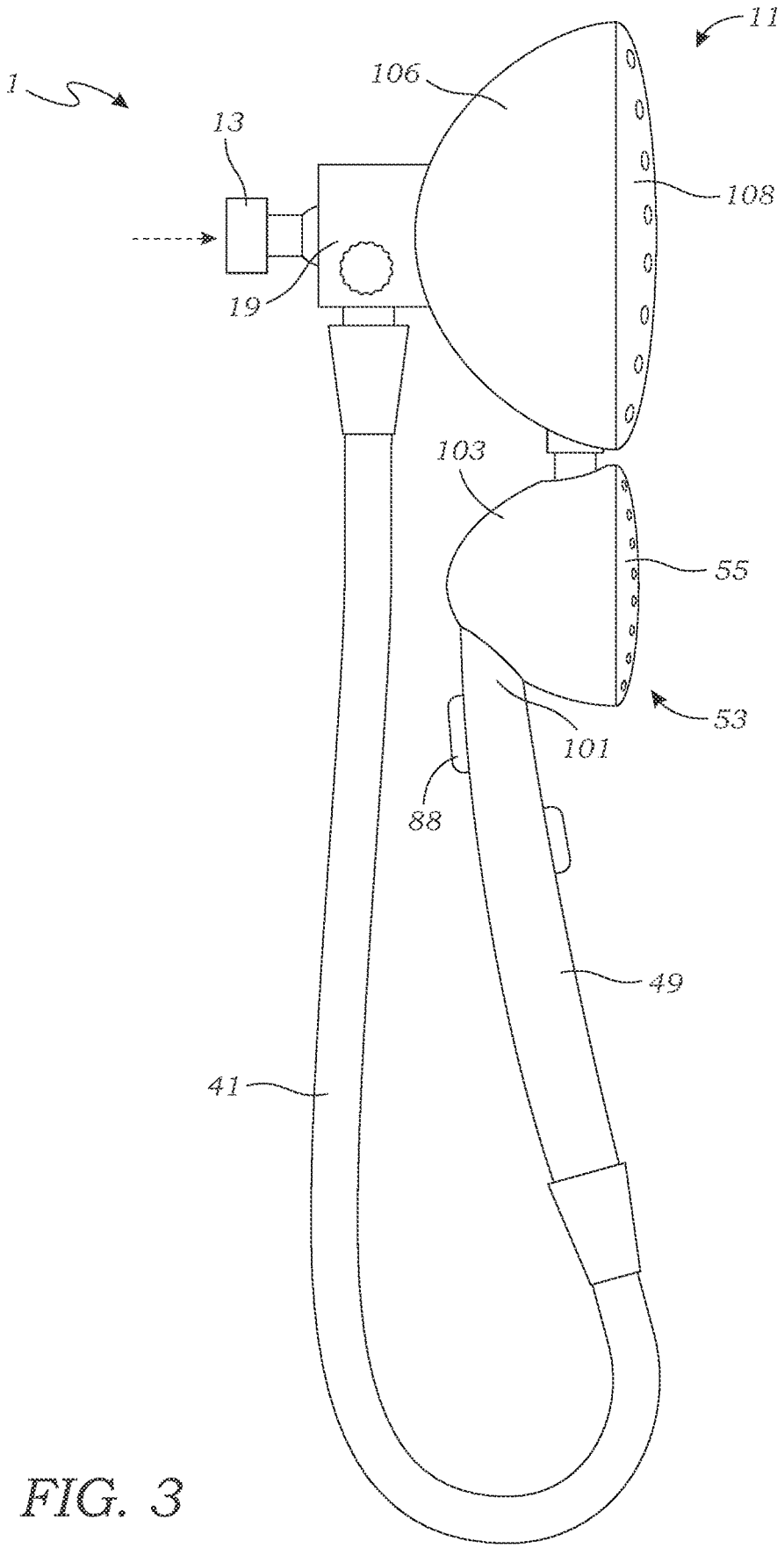
FIG. 3 is a left side perspective view of the handheld showerhead assembly of FIG. 2, wherein the showerheads are connected such that the stationary showerhead face and the handheld showerhead face axially align on the same parallel axis.
Figure 4:
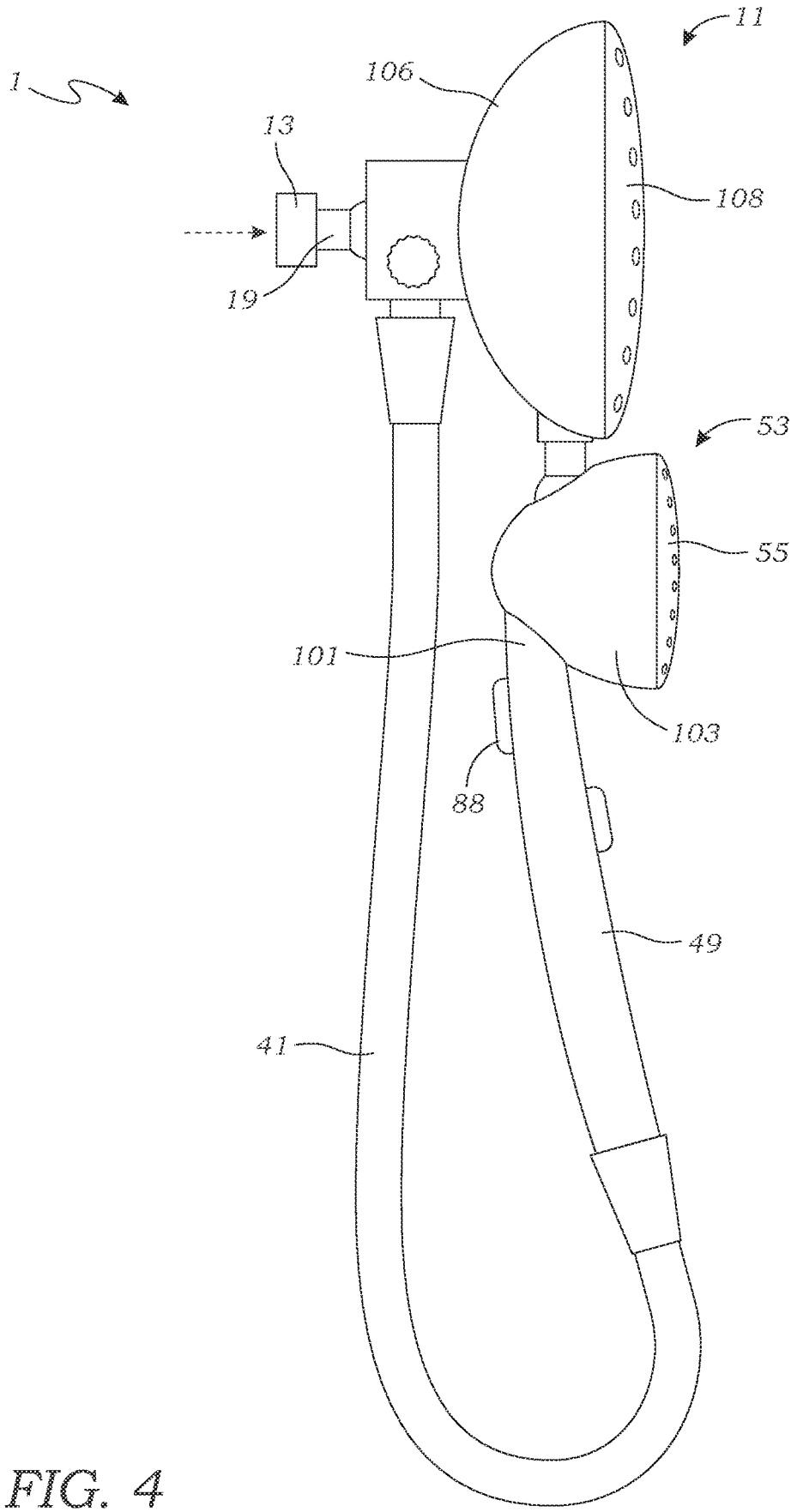
FIG. 4 is a left side perspective view of the handheld showerhead assembly of FIG. 2, wherein the showerheads are connected such that the stationary showerhead face and the handheld showerhead face are offset so as to not align along the same parallel axis.
Figure 5:
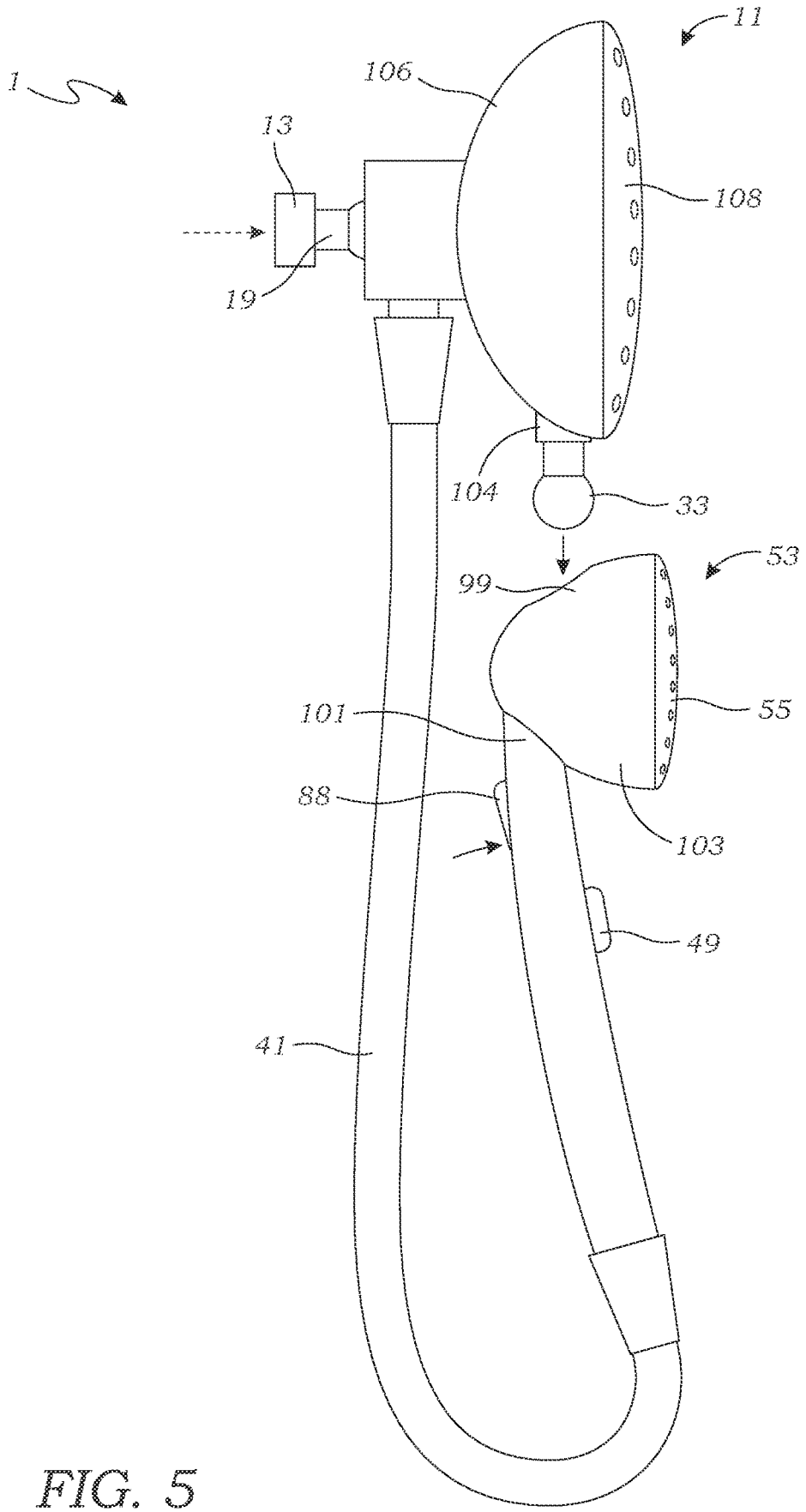
FIG. 5 is a left side partially exploded view of the handheld showerhead assembly of FIG. 2, wherein the handheld showerhead is disconnected from the stationary showerhead and no ball joint connection is experienced therebetween.
Figure 6:
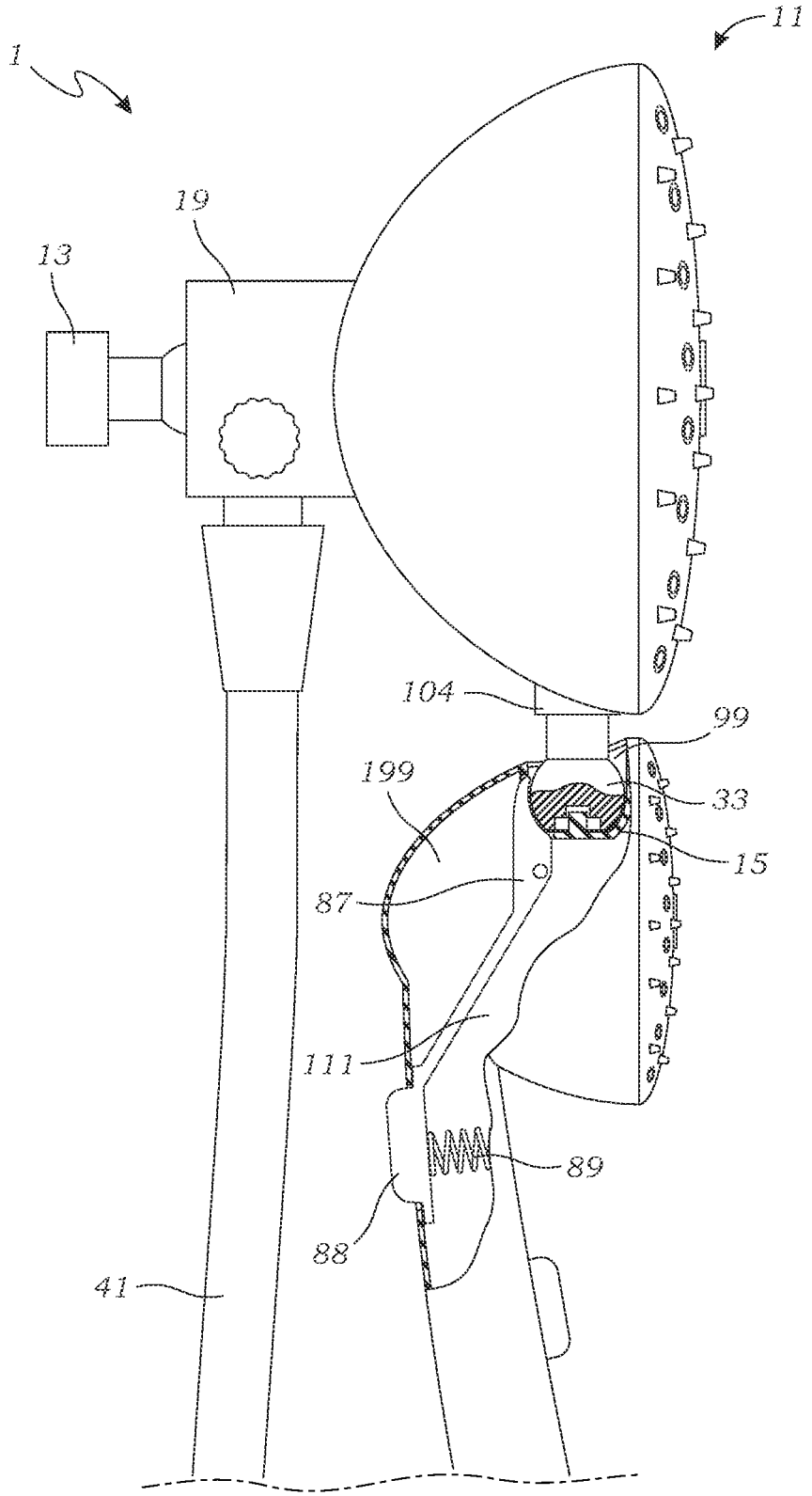
FIG. 6 is a left side partially cutaway view of the handheld showerhead assembly of FIG. 2 illustrating the handheld showerhead cavity's tension pin engaged with the stationary showerhead ball through its locking chamber and preliminary alignment chamber, and wherein the spring button tab mechanism's spring is in a decompressed state.
Figure 7:
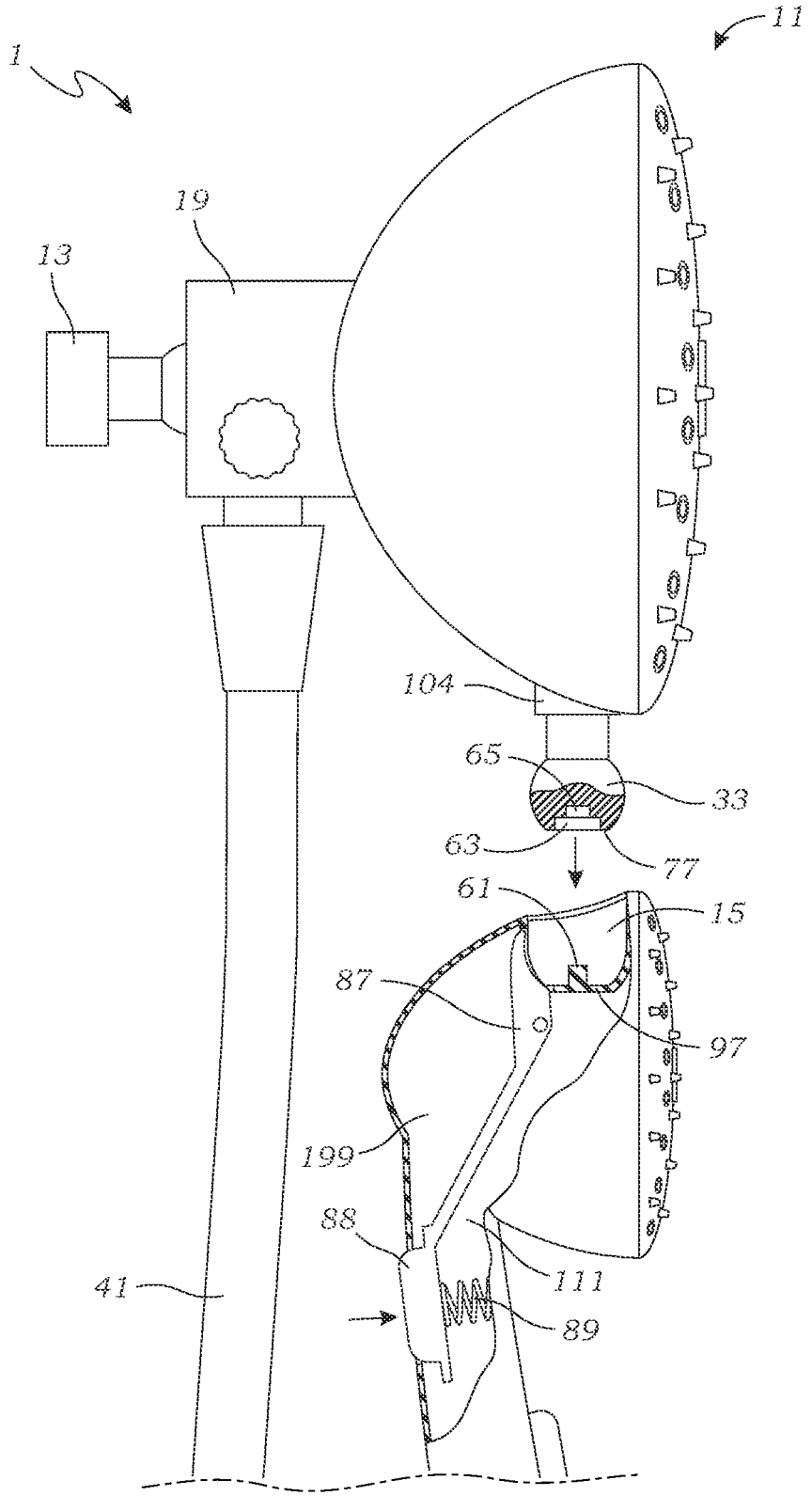
FIG. 7 is a left side partially exploded cutaway view of the handheld showerhead assembly illustrated in FIG. 2, wherein the spring is in its compressed state and the ball's locking chamber and preliminary alignment chamber are released from the cavity's tension pin.
Figure 9:
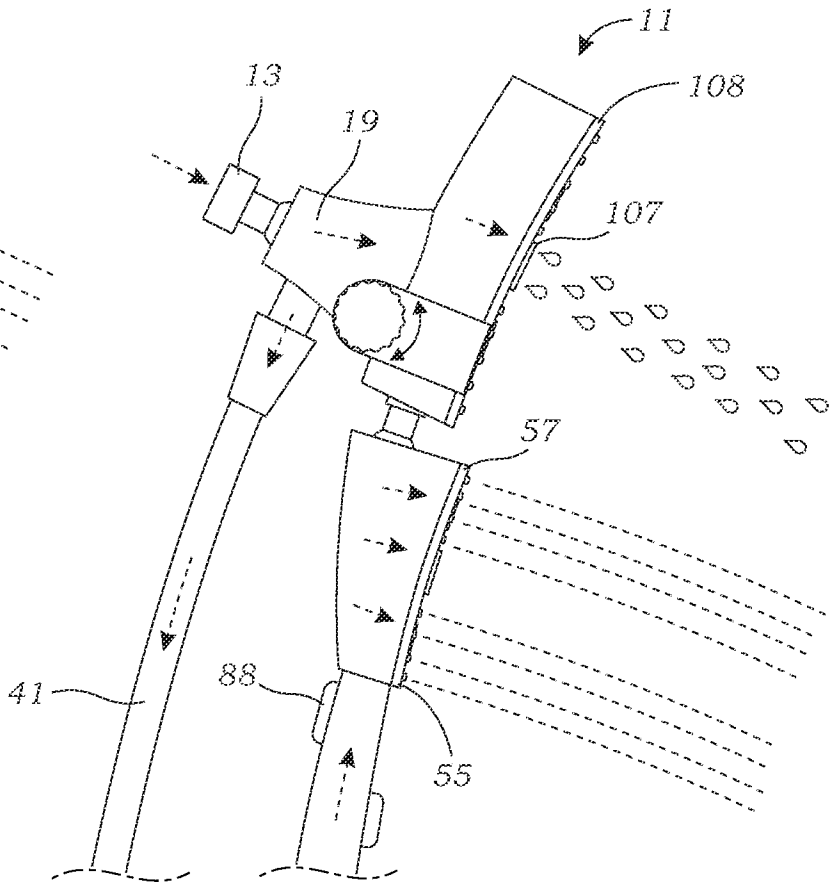
FIG. 9 is a left side perspective cutaway view of the handheld showerhead assembly of FIG. 1, illustrating water spraying through both the stationary showerhead nozzles and the handheld showerhead nozzles, wherein the neck portion's knob is turned so as to alter the spray pattern experienced by the stationary showerhead.
Figure 8:
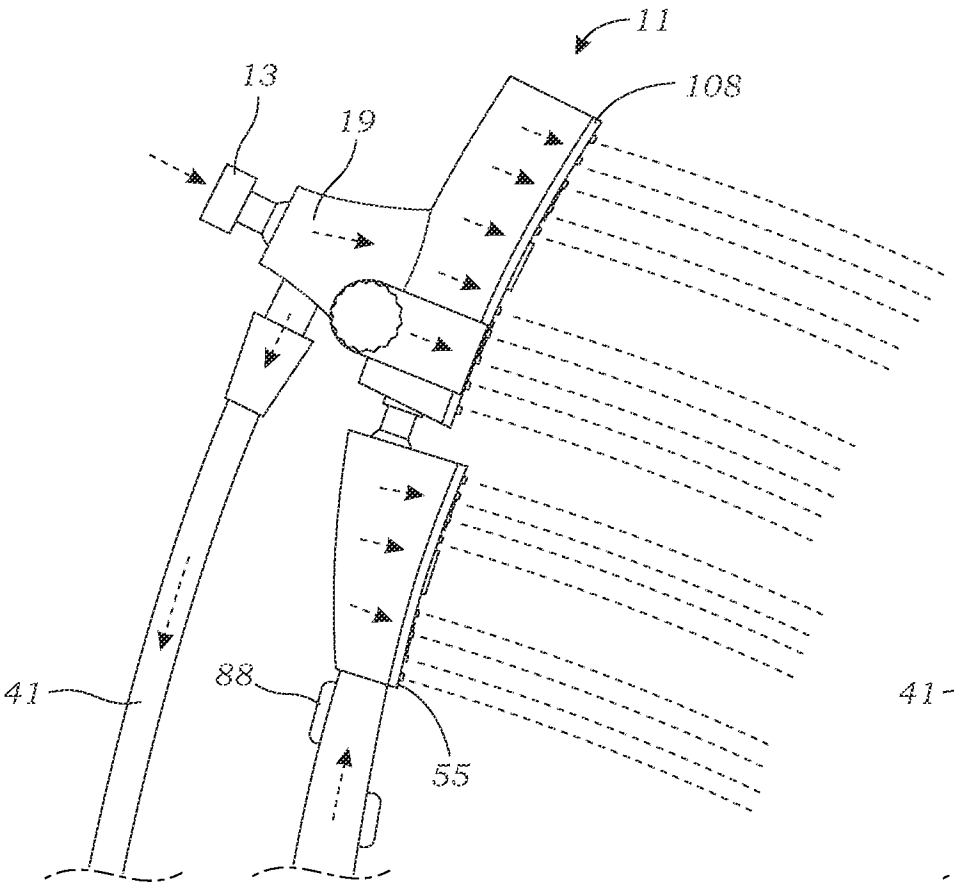
FIG. 8 is a left side perspective view of the handheld showerhead assembly of FIG. 1, illustrating the water flow from the inlet to the primary conduit and hose outlet, wherein water is released through both the stationary showerhead nozzles and the handheld showerhead nozzles.

When the showerheads are securely engaged through the ball joint connection, the handheld showerhead face 55 and the stationary showerhead faceplate 108 are oriented such that they axially align along the same plane, as described in FIGS. 3, 6 and 7. Alternatively, and as illustrated in FIGS. 4, 5, 8 and 9, the stationary showerhead 11 and the handheld showerhead 53 may be connected such that the stationary showerhead face 55 does not align in the same plane as the handheld showerhead 53.

Moreover, while the aforementioned preferred showerhead assemblies describe a handheld showerhead 53 having a cavity 15 housed within an upper housing 99 of the handheld showerhead's housing 103, and a ball 33 defined by a lower portion 104 of the stationary showerhead's body, it will be apparent that various modifications in ball 33 and cavity 15 orientation can be made without departing from the spirit and scope of the invention. For example, an alternative embodiment may be envisioned wherein the handheld showerhead housing 103 comprises a side portion having a cavity 15 and the stationary showerhead's body 106 comprises an upper or side housing that defines a ball 33 sized and configured to engaged with such cavity 15.

Additionally, in a preferred embodiment, the ball 33 is composed of deformable material. In an alternative embodiment, both the ball 33 and the cavity wall 15 are composed of deformable material. The ball's and/or cavity wall's deformable materials are provided so as to create frictional engagement and a locking connection between the stationery showerhead 11 and handheld showerhead 53. For this embodiment, the showerhead connection does not require a mechanical latch mechanism to lock the handheld showerhead to the stationary showerhead. Instead, the ball 33 and/or cavity opening are made of a malleable deformable material that allows the ball or cavity to deform when the ball enters or exits the cavity's opening. Preferably, the ball is made of a deformable material such as rubber, silicone, or a soft plastic. In addition, the ball may be hollow to facilitate the deformability of the ball when undergoing exterior forces.

Furthermore, the ball 33 and cavity opening may be dimensioned to facility the engagement and disengagement of the ball and cavity while still locking the handheld showerhead 53 to the fixed showerhead 11 when disengagement is not desired. For example, the cavity opening may have a diameter which is slightly smaller than the diameter of the ball. However, the deformability of the ball's construction allows it to deform to a smaller diameter to enter the cavity's interior when the handheld showerhead is manipulated by a bather. Once within the cavity, the ball's slightly diameter causes it to affix within the cavity until the bather exerts sufficient force to pull and deform the handheld showerhead's ball from within the stationary showerhead's cavity. In still an alternative construction, the handheld showerhead's ball may be substantially spherical, but the stationary showerhead's cavity's opening may be slightly oval in shape with the cavity opening's small axis being smaller than the ball's diameter. However, the cavity's opening's large axis may be slightly larger than the ball's spherical diameter. Upon forcing the ball into the spherical opening, the ball will deform into having an oval cross-sectional shape so as to allow the ball's 33 entry into and from the cavity 15.

Preferably, and as illustrated in FIGS. 6-7, the handheld showerhead's cavity 15 includes a tension pin 61 which extends axially from the cavity's planar surface 97. Even more preferably, the tension pin 61 is composed of plastic material. Additionally, the tension pin 61 is sized and configured to engage with corresponding structures that reside on the ball 33 wherein it provides tension therebetween to help maintain the handheld showerhead 53 in a desired position. Specifically, the ball 33 has a distal end 77 being planar and comprising a preliminary alignment chamber 63 and a second axially aligned smaller locking chamber 65. Preferably, the preliminary alignment chamber 63 and locking chamber 65 are both spherical in shape. The locking chamber 65 is sized and positioned to engage with the tension pin 61, wherein the engagement of the tension pin 61 with the locking chamber 65 prevents over-rotation of the ball 33 or inadvertent release of the handheld showerhead 53. Moreover, the preliminary alignment chamber 63 is sized and positioned for receipt of the tension pin 61. The engagement of the tension pin 61 with the preliminary alignment chamber 63 further stabilizes the connection realized between the handheld showerhead 53 and the stationary showerhead 11, and secures the ball 33 in place so as to prevent it from popping out of the cavity 15.

In another preferred embodiment, the showerhead handle 49 further comprises a spring-loaded button 88 and tab 87 mechanism. Preferably, and as best illustrated in FIGS. 6-7, the button 88 extends from the handle 49. Specifically, the button 88 is coupled with and fits on the tab 87 which is connected to the handle's rear side 199. Even more specifically, the tab 87 pivotally moves in an upward and downward trajectory and situated directly adjacent to the cavity 15. Additionally, the spring 89 is disposed within a chamber 111 within the handle 49 and is arranged so as bias the button 88 and tab 87. Furthermore, the spring 89 is configured so as to compress and decompress as a function of the button 88 and tab 87 mechanism. Moreover, the tab's 87 pivotal movement is dependent on and controlled by the button 88 and thereby, the state of compression of the spring 89.

Specifically, when the button 88 is not pressed, the spring 89 remains in a decompressed state and the tab 87 extends upwards so as to encapsulate the ball 33 received in the cavity 15 and thereby provide integral support for the connection experienced therebetween. Conversely, upon depression of the button 88, the spring 89 compresses and the tab 87 pivots downwardly. In this state, the tab 87 is no longer protruding upwards so as to encapsulate and provide support for the ball 33 received in the cavity 15. Various spring-loaded button and tab constructions for providing these capabilities can be selected by those skilled in the art.

Accordingly, as best illustrated in FIG. 6, once the handheld showerhead 53 is properly engaged with the ball 33, the handheld showerhead 53 is capable of pivoting both upwardly and downwardly, as well as left and right, so as to be able to spray water throughout a shower stall, as desired by the bather.

The present shower assembly provides an improved showerhead assembly wherein a stationary showerhead 11 functions as both a showerhead and a mounting structure for rotatably holding a handheld showerhead 53. Advantageously, the stationary showerhead 11 provides an easy connect docket for the handheld showerhead 53 in which the handheld showerhead 53 is securely positioned. Also advantageously, the ball joint connection allows the bather to orient the handheld showerhead 53 as desired so as to divert the stream of water to different locations within the shower enclosure.

While preferred showerhead assemblies have been illustrated and described, it will be apparent that various modifications can be made without departing from the spirit and scope of the invention. Alternative embodiments may be envisioned by those skilled in the art after consideration of the present disclosure. Accordingly, it will be apparent that various modifications can be made without departing from the spirit and scope of the invention. Therefore, having described my invention in such terms such as to enable a person skilled in the art to understand the invention, recreate the invention and practice it, and having presently identified the presently preferred embodiments thereof, I claim:

The invention claimed is:

1. A showerhead assembly comprising:

a showerhead neck portion having a female threaded inlet and a central conduit in fluid connection with said inlet;

a stationary showerhead including a showerhead body having a faceplate with a plurality of nozzles and a primary conduit for transporting water to said stationary showerhead's nozzles, said primary conduit being in fluid connection with said neck portion's central conduit so as to receive water therefrom and expel such water through said stationary showerhead's nozzles;

a handheld showerhead including an elongate hollow handle, said handheld showerhead having a showerhead housing with a front face and a plurality of nozzles projecting from said front face, said elongate hollow handle having a proximal end and a distal end with said distal end affixed to said handheld showerhead, said handheld showerhead further including a channel connecting said hollow handle's proximal end to said nozzles for transporting water received from said handle's proximal end to said nozzles;

a hose having a hose outlet, a first end, and second end, with said first end being threadably connected to said elongate handle's proximal end, said second end being threadably affixed to said neck portion, and said hose outlet being in fluid connection with said neck portion's central conduit so as to receive water from said central conduit and deliver such water to said handheld showerhead's nozzles; and a ball joint connector connecting said stationary showerhead to said handheld showerhead, and wherein said handheld showerhead further having an upper housing formed with a cavity, and said stationary showerhead body further including a ball sized and configured to releasably fit within said handheld showerhead's cavity, and said cavity is correspondingly sized so as to define a space configured to complementary receive said ball, wherein said ball extends downwardly from a lower portion of said stationary showerhead, wherein said faceplate and said front face are configured to axially align along a same plane when said ball is received by said cavity, and said handheld showerhead removably and rotatably docked onto said stationary showerhead by said ball within said cavity; and wherein said ball includes a preliminary alignment chamber and a locking chamber, wherein said locking chamber is smaller than said preliminary alignment chamber, and wherein said locking chamber is housed within and axially aligned with said preliminary alignment chamber.

2. The showerhead assembly of claim 1 wherein a fixed tension pin axially protrudes from within said cavity and is sized and configured to engage with said ball.

3. The showerhead assembly of claim 1 wherein said ball has a distal end being planar and housing a locking chamber sized and positioned to receive a tension pin axially protruding from within said cavity's planar surface.

4. The showerhead assembly of claim 3 wherein said ball's distal end includes a preliminary alignment chamber that houses said locking chamber and is sized and positioned for receipt of said tension pin.

5. The showerhead assembly of claim 1 wherein a fixed tension pin axially protrudes from within said cavity's planar surface, said ball has a distal end being planar and housing a locking chamber sized and positioned to receive a tension pin axially protruding from within said cavity's planar surface, wherein engagement of said locking chamber with said tension pin prevents over-rotation or inadvertent release of said ball, and said ball's distal end further includes a preliminary alignment chamber that houses said locking chamber and is sized and positioned for receipt of said tension pin whereby installation of said handheld showerhead to said stationary showerhead is further stabilized and secured.

6. The showerhead assembly of claim 1 wherein said showerhead handle further includes a spring, a button, and a tab, said button extends from said handle, said spring is disposed within an opening in said handle and arranged between said button and said handle, said spring is configured so that said spring compresses upon depression of said button and said spring decompresses when said button is not depressed, said tab is coupled with and fits said button to realize pivotal movement that is dependent upon depression of said button and compression of said spring, and said tab is positioned directly adjacent to said cavity so as to protrude into said cavity when in upward configuration.

7. The showerhead assembly of claim 6 wherein when said button is not depressed, said spring is in decompressed stated and said tab is protruding upwardly so as to capture said ball received in said cavity.

8. The showerhead assembly of claim 6 wherein when said button is depressed, said spring is compressed and said tab pivots to a position whereby it does not fully capture said ball.

9. The showerhead assembly of claim 1 wherein said hollow handle extends longitudinally to define a longitudinal axis, and said, showerhead's front face faces at an angle between 45° and 90° relative to said handle's longitudinal axis.

10. The showerhead assembly of claim 1 wherein said neck portion is connected to said female threaded inlet through a ball and a socket attachment configured to allow rotational movement of said neck portion relative to ball's center.

11. The showerhead assembly of claim 1 wherein said neck portion includes a diverter having a valve assembly for manually permitting or obstructing water flow through said primary conduit and through said hose outlet.

12. The showerhead assembly of claim 1 wherein said stationary showerhead's ball is has a diameter greater than the diameter of said handheld showerhead's cavity, and wherein said stationary showerhead's ball is configured to deform to a smaller diameter to enter an interior of said cavity.

13. The showerhead assembly of claim 12 wherein said stationary showerhead's ball is made of plastic, rubber or silicone.

14. The showerhead assembly of claim 1 wherein said ball has a distal end being planar and housing said preliminary alignment chamber and said locking chamber, wherein said preliminary alignment chamber is positioned between said distal end and said locking chamber.

* * * * *